US010113134B2

(12) United States Patent
Khelidj et al.

(10) Patent No.: US 10,113,134 B2
(45) Date of Patent: Oct. 30, 2018

(54) CAPPED OIL SOLUBLE POLYALKYLENE GLYCOLS WITH LOW VISCOSITY AND HIGH VISCOSITY INDEX

(71) Applicant: Dow Global Technologies LLC, Midland, MI (US)

(72) Inventors: Nadjet Khelidj, Horgen (CH); Martin R. Greaves, Horgen (CH); Marinus Meertens, Terneuzen (NL); Ronald Van Voorst, Vogelwaarde (NL)

(73) Assignee: Dow Global Technologies LLC, Midland, MI (US)

( * ) Notice: Subject to any disclaimer, the term of this patent is extended or adjusted under 35 U.S.C. 154(b) by 0 days.

(21) Appl. No.: 15/500,412

(22) PCT Filed: Jul. 21, 2015

(86) PCT No.: PCT/US2015/041218
§ 371 (c)(1),
(2) Date: Jan. 30, 2017

(87) PCT Pub. No.: WO2016/018669
PCT Pub. Date: Feb. 4, 2016

(65) Prior Publication Data

US 2017/0211009 A1 Jul. 27, 2017

Related U.S. Application Data

(60) Provisional application No. 62/031,201, filed on Jul. 31, 2014.

(51) Int. Cl.

| | |
|---|---|
| ***C10M 145/32*** | (2006.01) |
| ***C10M 145/34*** | (2006.01) |
| ***C10M 145/36*** | (2006.01) |
| ***C10M 107/34*** | (2006.01) |

(52) U.S. Cl.
CPC ..... *C10M 145/32* (2013.01); *C10M 107/34* (2013.01); *C10M 145/34* (2013.01); *C10M 145/36* (2013.01); *C10M 2209/106* (2013.01); *C10M 2209/107* (2013.01); *C10M 2209/108* (2013.01); *C10M 2209/1065* (2013.01); *C10M 2209/1075* (2013.01); *C10M 2209/1085* (2013.01); *C10N 2220/022* (2013.01); *C10N 2230/02* (2013.01)

(58) Field of Classification Search
CPC ..... C10M 2209/107; C10M 2209/1075
USPC ..... 508/579
See application file for complete search history.

(56) References Cited

U.S. PATENT DOCUMENTS

| | | | | |
|---|---|---|---|---|
| 5,652,204 | A | 7/1997 | Cracknell et al. | |
| 6,362,140 | B1 * | 3/2002 | McGraw | C08G 18/10 508/579 |
| 7,456,138 | B2 * | 11/2008 | Sherman | C08G 65/2609 508/513 |
| 8,357,644 | B2 * | 1/2013 | Thoen | C10M 141/06 508/579 |
| 8,969,271 | B2 * | 3/2015 | Greaves | C10M 107/34 508/579 |
| 9,546,335 | B2 * | 1/2017 | Obrecht | C10M 169/04 |
| 2013/0005633 | A1 * | 1/2013 | Habeeb | C10M 169/04 508/579 |
| 2013/0017981 | A1 | 1/2013 | Bush | |
| 2013/0313469 | A1 | 11/2013 | Kaneko | |
| 2014/0018273 | A1 | 1/2014 | Zweifel et al. | |
| 2014/0194333 | A1 * | 7/2014 | Dance | C10M 145/36 508/580 |
| 2014/0303053 | A1 * | 10/2014 | Greaves | C10M 169/04 508/282 |
| 2015/0119303 | A1 * | 4/2015 | Guerin | C10M 145/00 508/287 |
| 2016/0083670 | A1 * | 3/2016 | Ido | C10M 173/02 451/28 |
| 2017/0218296 | A1 * | 8/2017 | Khelidj | C10M 135/04 |
| 2017/0226442 | A1 * | 8/2017 | Sanson | C10M 107/34 |

FOREIGN PATENT DOCUMENTS

| | | | | |
|---|---|---|---|---|
| WO | 2009134638 | | 11/2009 | |
| WO | WO-2012134794 | A1 * | 10/2012 | C10M 107/34 |

OTHER PUBLICATIONS

International Search Report & Written Opinion for related PCT Application PCT/US2015/041218, dated Oct. 13, 2015 (10 pgs).

* cited by examiner

*Primary Examiner* — Ellen M McAvoy
(74) *Attorney, Agent, or Firm* — Brooks, Cameron & Huebsch, PLLC

(57) ABSTRACT

A capped oil soluble polyalkylene glycol has the following structure: $R^1O\text{-}(AO)_n\text{—}R^2$ where: $R^1$ is a linear or branched alkyl or aryl with one to 18 carbon atoms; AO refers to residuals of monomers selected from 1,2-butylene oxide and 1,2-propylene oxide selected so that at least 50 weight-percent of the $(AO)_n$ component is 1,2-butylene oxide residuals; n is selected to provide a kinematic viscosity at 100 degrees Celsius of less than 5 centiStokes for the non-capped polyalkylene glycol; and $R^2$ is a linear or branched alkyl or aryl having from 1-8 carbon atoms and wherein the capped oil soluble polyalkylene glycol is characterized by having a kinematic viscosity of less than 4.5 centiStokes at 100 degrees Celsius and a viscosity index of greater than 150.

7 Claims, No Drawings

CAPPED OIL SOLUBLE POLYALKYLENE GLYCOLS WITH LOW VISCOSITY AND HIGH VISCOSITY INDEX

This application is a National Stage Application under 35 U.S.C. § 371 of International Application Number PCT/US2015/041218, filed Jul. 21, 2015 and published as WO 2016/018669 on Feb. 4, 2016, which claims the benefit to U.S. Provisional Application 62/031,201, filed Jul. 31, 2014, the entire contents of which are incorporated herein by reference in its entirety.

BACKGROUND OF THE INVENTION

Field of the Invention

The present invention relates to a capped oil soluble polyalkylene glycol having a kinematic viscosity at 100° C. below 4.5 centiStokes and a viscosity index greater than 150.

Introduction

A macro-trend across the lubricant industry is the search for and the development of base fluids that offer lower viscosities than current base oils but preferably with higher viscosity index values. Formulations that contain lower viscosity base oils can offer lower friction losses inside equipment and therefore improved energy efficiency.

Today most lubricant compositions use hydrocarbon oils as the base oil. However it is well known that as the viscosity is lowered for hydrocarbon oils, the viscosity index is also usually lowered. It is desirable to have a base oil with a kinematic viscosity at 100° C. that is less than 4.5 centiStokes (cSt), preferably four cSt or less, and a viscosity index greater than 150. Today API (American Petroleum Institute) Group I and II hydrocarbon oils that have a kinematic viscosity at 100° C. that is 4.5 cSt or less and have viscosity index values in the range 80-120 or lower. Synthetic hydrocarbons such as polyalphaolefins have values which are slightly higher. For example Synfluid PAO-4 from Chevron Phillips has a kinematic viscosity at 100° C. that is four cSt and a viscosity index value that is 124.

Traditional polyalkylene glycols (PAGs) such as co-polymers of ethylene oxide (EO) and propylene oxide (PO) and homo-polymers of propylene oxide offer higher viscosity index values than hydrocarbon oils for similar viscosity grades. However, the viscosity index still decreases with viscosity for the PAGs. Capping these polymers (EO and/or PO types) with an alkyl or aryl group can increase their viscosity index values by about 20-50 units. For example PAGs having a kinematic viscosity at 100° C. of 5-20 cSt in which methyl capping results in viscosity index increase of 20-50 over the non-capped PAG to yield values of 180-250. Capped PAGs of ethylene oxide and propylene oxide have a drawback of being expensive components of lubricant formulations. Another major disadvantage is that they are not soluble in hydrocarbon oils at higher treat levels (for example, greater than 10 percent by weight). Therefore they cannot be used as co-base oils in hydrocarbon oils.

In order to overcome hydrocarbon solubility challenges, a new range of polyalkylene glycols called oil soluble polyalkylene glycols (OSP) were developed. OSPs contain 1,2-butylene oxide as a building block. There is now a commercially available family of OSPs that are dodecanol initiated PO/BO (50/50 weight ratio) copolymers. One end of the polymer is terminated with a dodecanol group but the other has a free hydroxyl group. Their commercial names are UCON™ OSP-18, 32, 46, 68, 150 and 220 (UCON is a trademark of Union Carbide Corporation). However low viscosity OSPs have quite low viscosity index values. For example UCON OSP-18 has a kinematic viscosity at 100° C. of four cSt and a viscosity index value of 123. It is desirable to have a kinematic viscosity at 100° C. of 4.5 or less, preferably four cSt or less, and a viscosity index of 150.

Overall, there is a desire to achieve low kinematic viscosities (less than 4.5 cSt at 100° C.) with high (above 150) viscosity index values in an oil soluble polyalkylene glycol.

BRIEF SUMMARY OF THE INVENTION

The present invention provides a solution to achieving low kinematic viscosities (less than 4.5 cSt, preferably four less cSt at 100° C.) with high viscosity index values (greater than 150) in an oil soluble polyalkylene glycol.

The present invention is a result of that capping OSPs can unexpectedly boost their viscosity index values by 50 units or more, which is a greater increase in viscosity index observed with capping non-oil soluble OSPs (for example, polyalkylene glycols of ethylene oxide and propylene oxide). Therefore, by capping a non-capped OSP having a kinematic viscosity of less than five cSt (which typically have an undesirably low viscosity index) the kinematic viscosity at 100° C. can be reduced to less than 4.5 cSt, even four cSt or less while at the same time the viscosity index can be dramatically increased to obtain desirable target values in excess of 150.

In a first aspect, the present invention is a capped oil soluble polyalkylene glycol having the following structure:

$$R^1O\text{-}(AO)_n\text{—}R^2$$

where: $R^1$ is a linear or branched alkyl or aryl with one to 18 carbon atoms; AO refers to residuals of monomers selected from 1,2-butylene oxide and 1,2-propylene oxide selected so that at least 50 weight-percent of the $(AO)_n$ component is 1,2-butylene oxide residuals; n is selected to provide a kinematic viscosity at 100 degrees Celsius of less than 5 centiStokes for the non-capped polyalkylene glycol; and $R^2$ is a linear or branched alkyl or aryl having from 1-8 carbon atoms and wherein the capped oil soluble polyalkylene glycol is characterized by having a kinematic viscosity of less than 4.5 centiStokes at 100 degrees Celsius and a viscosity index of greater than 150.

The present invention is useful as a component of lubricating fluids comprising a hydrocarbon base oil to increase viscosity index of the lubricating oil without dramatically increasing kinematic viscosity.

DETAILED DESCRIPTION OF THE INVENTION

"And/or" means "and, or alternatively". All ranges include endpoints unless otherwise stated.

Test methods refer to the most recent test method as of the priority date of this document unless a date is indicated with the test method number as a hyphenated two digit number. References to test methods contain both a reference to the testing society and the test method number. Test method organizations are referenced by one of the following abbreviations: ASTM refers to ASTM International (formerly known as American Society for Testing and Materials); EN refers to European Norm; DIN refers to Deutsches Institut für Normung; and ISO refers to International Organization for Standards.

Determine kinematic viscosity according to ASTM D7042. Determine viscosity index for a lubricant composition according to ASTM D2270. Determine pour point temperature according to ASTM D97.

Determine molecular weight for non-capped oil soluble polyalkylene glycol polymers in grams per mole (g/mol) from the OH (hydroxyl) number according to ASTM D4274. Determine the molecular weight for capped oil soluble polyalkylene glycol polymers by adding the weight of the aping agent minus one. For example, the molecular weight of a methyl capping group is 15, but since the methyl group is chemically replacing a hydrogen on the non-capped PAG the resulting molecular weight of the PAG is increased by 15 from the capping group but reduced by one from loss of the hydrogen that is replaced.

As used herein, "residual" means the portion of a monomer or initiator that is incorporated into a polymer after polymerization. For example, the residual of an alcohol initiator used in polymerizing a polyalkylene glycol is the alkoxide (alcohol without the alcohol hydrogen). The residual of propylene oxide in a PAG formed by polymerizing in propylene oxide is (—$CH_2CH(CH_3)O$—). The residual of 1,2-butylene oxide in a PAG formed using 1,2-butylene oxide is (—$CH_2CH(CH_2CH_3)O$—).

The capped oil soluble polyalkylene glycol (capped OSP) of the present invention has the following structure:

$$R^1O\text{-}(AO)_n\text{—}R^2$$

$R^1O$ corresponds to the residual of an alcohol initiator used during the polymerization of the polyalkylene glycol (PAG). $R^1$ can be alkyl or aryl and can be linear or branched. $R^1$ has one or more, preferably two or more, three or more, four or more, five or more, six or more, seven or more, eight or more and can have ten or more carbon atoms and at the same time has 18 or fewer, preferably 16 or fewer and can have 14 or fewer, 13 or fewer, even 12 or fewer carbon atoms. Examples of suitable alcohol initiators, of which $R^1O$ would be a residual, include 2-ethylhexanol, dodecanol and tridecanol.

$(AO)_n$ corresponds to a polyalkylene glycol component and comprises a total of n residuals of monomers selected from 1,2-butylene oxide (BO) and 1,2-propylene oxide (PO). Each AO unit corresponds independently to either BO or PO. BO residuals make up 50 weight-percent (wt %) or more, and possibly 75 wt % or even 100 wt % of the polyalkylene glycol component. When the polyalkylene glycol component is a copolymer of BO and PO then the copolymer can be a block copolymer or a random copolymer. The polyalkylene glycol component is desirably free of residuals from ethylene oxide.

The value of n in $(AO)_n$ is selected to achieve a desirable kinematic viscosity and viscosity index for the OSP. In particular, the number of BO residuals and PO residuals are chosen to achieve a kinematic viscosity at 100° C. that is less than five cSt for the uncapped OSP. The "uncapped OSP" corresponds to the structure above, but where $R^2$ is a hydrogen. The optimal number of BO and PO residuals can readily be determined for a selected $R^1$ and $R^2$. Typically, n is a number that is three or more, preferably four or more and can be five or more, six or more even seven or more while at the same time is typically nine or less, preferably eight or less and can be seven or less, even six or less. For individual OSP molecules, n, m and p are integer values yet for multiple molecules one or ordinary skill understands that the collection of molecules can have an average value for n, m and/or p that is not an integer. The average value of m, n and p for the OSP molecules of the invention fall within the specified range In general, it is desirably for the molecular weight of the capped OSP to be less than 700 g/mol, preferably 600 g/mol or less while at the same time the molecular weight is desirably 200 g/mol or more.

The OSP is "capped" which means that the terminal hydroxyl group of the alcohol initiated PAG is reacted to form an ether group by replacing the terminal hydroxyl hydrogen with an aryl or alkyl group. $R^2$ corresponds to the aryl or alkyl group that forms the "cap" on the OSP. $R^2$ can be linear or branched. $R^2$ has one or more carbon atom and can have two or more, three or more, four or more carbon atoms while at the same time generally has eight or fewer, preferably six or fewer carbon atoms and can have five or fewer, and even four or fewer carbon atoms. Examples of suitable $R^2$ groups include those selected from a group consisting of methyl, butyl and benzyl. $R^2$ is most desirably a methyl in order to achieve greater viscosity index increase.

Capped OSPs of the present invention have an unexpectedly high viscosity index while retaining a relatively low viscosity (less than 4.5 cSt, preferably four cSt or less at 100° C.). Capping the OSP provides an even greater increase in viscosity index than capping PAGs that are not oil soluble, more specifically, than capping PAGs that contain residuals from ethylene oxide in the $(AO)_n$ portion of the PAG.

The capped OSPs of the present invention are useful for blending with hydrocarbon base oils to form lubricants having kinematic viscosity below 4.5 cSt, even four cSt or less at 100° C. and that have a viscosity index of 150 or higher. Currently, American Petroleum Institute (API) group I, II and III hydrocarbon oils that have a kinematic viscosity at 100° C. of less than 4 cSt have a viscosity index of 120 or lower. Group IV hydrocarbon oils have slightly higher viscosity index values, are still typically below 150.

EXAMPLES

Effect of Capping a Non-OSP PAG

The groupings below provide a Comparative Example (Comp Ex) of a PAG of PO or PO copolymerized with ethylene oxide and a capped version of the same PAG. Kinematic viscosity at 40° C. (KV40) and at 100 C (KV100), viscosity index (VI) and the difference between viscosity index of the capped and non-capped PAG (Delta VI) is provided in Table 1. While the capping increases viscosity index values of the PAG, the increase is generally not as extensive as surprisingly demonstrated with the OSPs, shown in the next subsection.

Comparative Examples A and B

Prepare Comparative Example (Comp Ex) A by loading 2446 grams (g) of dipropylene glycol n-butyl ether (for example, DOWANOL™ DPnB, DOWANOL is a trademark of The Dow Chemical Company) into a stainless steel reactor vessel followed by 27.5 g of 45 wt % aqueous potassium hydroxide. Heat the mixture to 115° C. under a nitrogen blanket. Remove water by means of vacuum to a level below 2000 ppm. Feed a mixture of 1510 g 1,2-propylene oxide and 2517 g ethylene oxide into the reactor at a temperature of 135° C. and a pressure of 500 kiloPascals (kPa). Stir the mixture and allow to digest for 12 hours at 135° C. Remove residual catalyst by filtration through a magnesium silicate filtration bed at 50° C. to yield Comp Ex A, which has a kinematic viscosity at 40° C. (KV40) of 18.9 cSt, kinematic viscosity at 100° C. of 4.70 cSt, and a viscosity index (VI) of 180.

Prepare Comp Ex B by loading 6021 g of comp Ex A into a stainless steel reactor vessel. Add 2881 g of sodium methoxide (25 wt % solution in methanol) and stir at 120° C. for 20 hours under vacuum (45 to less than one kPa) with nitrogen purging at 200 milliliters per minute and stirring at 180 revolutions per minute (RPM). Feed 740 g of methyl chloride into the reactor at a temperature of 80° C. and pressure of 170 kPa. Stir the mixture and allow to digest for one hour at 80° C. Flash for 20 minutes at 80° C. and apply vacuum to remove unreacted methyl chloride from the mixture. Add 2316 g water and mix for 60 minutes at 80° C. Stop stirring and allow to settle for 1.5 hours at 80° C. Decant 2890 g of brine phase. Add 100 g magnesium silicate and flash off residual water for one hour at 100° C. under vacuum and pressure below one kPa with nitrogen purging at 200 milliliters per minute and stirring at 180 RPM. Cool the product to 60° C. discharge 5839 g and filter through a magnesium silicate filtration bed at 50° C. to yield Comp Ex B. Capping conversion is 99.8%, KV40 is 11.0 cSt, KV100 is 3.55, and VI is 240.

Comparative Examples C and D

Prepare Comp Ex C by loading 1683 grams (g) of dipropylene glycol n-butyl ether (for example, DOWANOL™ DPnB, DOWANOL is a trademark of The Dow Chemical Company) into a stainless steel reactor vessel followed by 27.6 g of 45 wt % aqueous potassium hydroxide Heat the mixture to 115° C. under a nitrogen blanket. Remove water by means of vacuum to a level below 2000 ppm. Feed a mixture of 2395 g propylene oxide and 2395 g ethylene oxide into the reactor at a temperature of 135° C. and a pressure of 500 kiloPascals (kPa). Stir the mixture and allow to digest for 12 hours at 135° C. Remove residual catalyst by filtration through a magnesium silicate filtration bed at 50° C. to yield Comp Ex C, which has a KV40 of 30.4 cSt, KV100 of 6.97 cSt, and a VI of 202.

Prepare Comp Ex D by loading 8004 g of comp Ex C into a stainless steel reactor vessel. Add 2545 g of sodium methoxide (25 wt % solution in methanol) and stir at 120° C. for 20 hours under vacuum (45 to less than one kPa) with nitrogen purging at 200 milliliters per minute and stirring at 180 revolutions per minute (RPM). Feed 625 g of methyl chloride into the reactor at a temperature of 80° C. and pressure of 170 kPa. Stir the mixture and allow to digest for one hour at 80° C. Flash for 20 minutes at 80° C. and apply vacuum to remove unreacted methyl chloride from the mixture. Add 2125 g water and mix for 60 minutes at 80° C. Stop stirring and allow to settle for 1.5 hours at 80° C. Decant 2435 g of brine phase. Add 100 g magnesium silicate and flash off residual water for one hour at 100° C. under vacuum and pressure below one kPa with nitrogen purging at 200 milliliters per minute and stirring at 180 RPM. Cool the product to 60° C. discharge 7073 g and filter through a magnesium silicate filtration bed at 50° C. to yield Comp Ex D. Capping conversion is 99.7%, KV40 is 20.2 cSt, KV100 is 5.63, and VI is 248.

Comparative Examples E and F

Prepare Comp Ex E by loading 2387 grams (g) of dipropylene glycol n-butyl ether (for example, DOWANOL™ DPnB, DOWANOL is a trademark of The Dow Chemical Company) into a stainless steel reactor vessel followed by 40.6 g of 45 wt % aqueous potassium hydroxide and heat the mixture to 115° C. under a nitrogen blanket. Remove water by means of vacuum to a level below 2000 ppm. Feed 4630 g propylene oxide into the reactor at a temperature of 125° C. and a pressure of 500 kiloPascals (kPa). Stir the mixture and allow to digest for 12 hours at 125° C. Remove residual catalyst by filtration through a magnesium silicate filtration bed at 50° C. to yield Comp Ex E, which has a KV40 of 17.1 cSt, KV100 of 4.0 cSt, and a VI of 136.

Prepare Comp Ex F by loading 6810 g of comp Ex E into a stainless steel reactor vessel. Add 2703 g of sodium methoxide (25 wt % solution in methanol) and stir at 120° C. for 20 hours under vacuum (45 to less than one kPa) with nitrogen purging at 200 milliliters per minute and stirring at 180 revolutions per minute (RPM). Feed 663 g of methyl chloride into the reactor at a temperature of 80° C. and pressure of 170 kPa. Stir the mixture and allow to digest for one hour at 80° C. Flash for 20 minutes at 80° C. and apply vacuum to remove unreacted methyl chloride from the mixture. Add 2145 g water and mix for 60 minutes at 80° C. Stop stirring and allow to settle for 1.5 hours at 80° C. Decant 2827 g of brine phase. Add 100 g magnesium silicate and flash off residual water for one hour at 100° C. under vacuum and pressure below one kPa with nitrogen purging at 200 milliliters per minute and stirring at 180 RPM. Cool the product to 60° C. discharge 6819 g and filter through a magnesium silicate filtration bed at 50° C. to yield Comp Ex F. Capping conversion is 97.8%, KV40 is 10.2 cSt, KV100 is 3.20, and VI is 202.

Comparative Examples G, H and I

Prepare Comp Ex G by loading 1500 grams (g) of dipropylene glycol n-butyl ether (for example, DOWANOL™ DPnB, DOWANOL is a trademark of The Dow Chemical Company) into a stainless steel reactor vessel followed by 37.7 g of 45 wt % aqueous potassium hydroxide Heat the mixture to 115° C. under a nitrogen blanket and remove water by means of vacuum to a level below 2000 ppm. Feed 4960 g propylene oxide into the reactor at a temperature of 125° C. and a pressure of 500 kiloPascals (kPa). Stir the mixture and allow to digest for 12 hours at 125° C. Remove residual catalyst by filtration through a magnesium silicate filtration bed at 50° C. to yield Comp Ex G, which has a KV40 of 29.9 cSt, KV100 of 6.38 cSt, and a VI of 174.

Prepare Comp Ex H by loading 2447 g of comp Ex G into a stainless steel reactor vessel. Add 726 g of sodium methoxide (25 wt % solution in methanol) and stir at 120° C. for 20 hours under vacuum (45 to less than one kPa) with nitrogen purging at 200 milliliters per minute and stirring at 180 revolutions per minute (RPM). Feed 178 g of methyl chloride into the reactor at a temperature of 80° C. and pressure of 170 kPa. Stir the mixture and allow to digest for one hour at 80° C. Flash for 20 minutes at 80° C. and apply vacuum to remove unreacted methyl chloride from the mixture. Add 598 g water and mix for 60 minutes at 80° C. Stop stirring and allow to settle for 1.5 hours at 80° C. Decant 767 g of brine phase. Add 100 g magnesium silicate and flash off residual water for one hour at 100° C. under vacuum and pressure below one kPa with nitrogen purging at 200 milliliters per minute and stirring at 180 RPM. Cool the product to 60° C. discharge 2435 g and filter through a magnesium silicate filtration bed at 50° C. to yield Comp Ex H. Capping conversion is 97.5%, KV40 is 19.9 cSt, KV100 is 5.31, and VI is 222.

Prepare Comp Ex I by loading 2986 g of comp Ex G into a stainless steel reactor vessel. Add 845 g of sodium methoxide (25 wt % solution in methanol) and stir at 120° C. for 20 hours under vacuum (45 to less than one kPa) with nitrogen purging at 200 milliliters per minute and stirring at 180 revolutions per minute (RPM). Feed 452 g of benzyl chloride into the reactor at a temperature of 80° C. and pressure of 170 kPa. Stir the mixture and allow to digest for one hour at 80° C. Flash for 20 minutes at 80° C. and apply vacuum to remove unreacted benzyl chloride from the mixture. Add 674 g water and mix for 60 minutes at 80° C. Stop stirring and allow to settle for 3.5 hours at 80° C. Decant 479 g of brine phase. Add 100 g magnesium silicate and flash off residual water for one hour at 100° C. under vacuum and pressure below one kPa with nitrogen purging at 200 milliliters per minute and stirring at 180 RPM. Cool the product to 60° C. discharge 3264 g and filter through a magnesium silicate filtration bed at 50° C. to yield Comp Ex I. Capping conversion is 88.2%, KV40 is 28.2 cSt, KV100 is 6.61 cSt, and VI is 203.

Comparative Examples J and K

Prepare Comp Ex J by loading 1344 grams (g) of dodecanol (Nacol™ 12-99 (Nacol is a trademark of Sasol Germany GMBH)) into a stainless steel reactor vessel followed by 28.9 g of 45 wt % aqueous potassium hydroxide and heat the mixture to 115° C. under a nitrogen blanket. Remove the water by means of vacuum to a level below 2000 ppm. Feed 5161 g propylene oxide into the reactor at a temperature of 130° C. and a pressure of 500 kiloPascals (kPa). Stir the mixture and allow to digest for 12 hours at 130° C. Remove residual catalyst by filtration through a magnesium silicate filtration bed at 50° C. to yield Comp Ex J, which has a KV40 of 36.1 cSt, KV100 of 7.49 cSt, and a VI of 181.

Prepare Comp Ex K by loading 5712 g of comp Ex J into a stainless steel reactor vessel. Add 1615 g of sodium methoxide (25 wt % solution in methanol) and stir at 120° C. for 20 hours under vacuum (45 to less than one kPa) with nitrogen purging at 200 milliliters per minute and stirring at 180 revolutions per minute (RPM). Feed 415 g of methyl chloride into the reactor at a temperature of 80° C. and pressure of 170 kPa. Stir the mixture and allow to digest for one hour at 80° C. Flash for 20 minutes at 80° C. and apply vacuum to remove unreacted methyl chloride from the mixture. Add 1294 g water and mix for 60 minutes at 80° C. Stop stirring and allow to settle for 1.5 hours at 80° C. Decant 1595 g of brine phase. Add 100 g magnesium silicate and flash off residual water for one hour at 100° C. under vacuum and pressure below one kPa with nitrogen purging at 200 milliliters per minute and stirring at 180 RPM. Cool the product to 60° C. discharge 5755 g and filter through a magnesium silicate filtration bed at 50° C. to yield Comp Ex K. Capping conversion is 98.7%, KV40 is 25.0 cSt, KV100 is 6.4, and VI is 227.

TABLE 1

| Sample | Initiator | $(AO)_n$ component (weight ratio of each alkylene oxide monomer residual) | Cap | Molecular Weight (g/mol) | KV40 cSt | KV100 cSt | Viscosity Index (VI) | Delta VI |
|---|---|---|---|---|---|---|---|---|
| Comp Ex A | Butanol | EO/PO (50/50) | None | 501 | 18.9 | 4.7 | 180 | |
| Comp Ex B | Butanol | EO/PO (50/50) | Methyl | 515 | 11 | 3.5 | 240 | 60 |
| Comp Ex C | Butanol | EO/PO (50/50) | None | 710 | 30.4 | 6.97 | 202 | |
| Comp Ex D | Butanol | EO/PO (50/50) | Methyl | 724 | 20.2 | 5.63 | 248 | 46 |
| Comp Ex E | Butanol | PO (100) | None | 545 | 17.1 | 4.00 | 136 | |
| Comp Ex F | Butanol | PO (100) | Methyl | 559 | 10.2 | 3.20 | 202 | 66 |
| Comp Ex G | Butanol | PO (100) | None | 765 | 29.9 | 6.38 | 174 | |
| Comp Ex H | Butanol | PO (100) | Methyl | 779 | 19.9 | 5.31 | 222 | 48 |
| Comp Ex I | Butanol | PO (100) | Benzyl | 844 | 28.2 | 6.61 | 203 | 29 |
| Comp Ex J | Dodecanol | PO (100) | None | 856 | 36.1 | 7.49 | 181 | |
| Comp Ex K | Dodecanol | PO (100) | Methyl | 870 | 25.0 | 6.4 | 227 | 46 |

Effect of Capping an OSP to Form Examples of the Invention

The groupings below provide a Comp Ex OSP and one or more than one Example (Ex) of a capped version of the same OSP that falls within the scope of the invention. Kinematic viscosity at 40° C. (KV40) and at 100 C (KV100), viscosity index (VI) and the difference between viscosity index of the capped and non-capped PAG (Delta VI) is provided in Table 2. The data reveals the dramatic increase in viscosity index and concomitant decrease in kinematic viscosity after capping.

Comparative Example L and Example 1

Prepare Comp Ex L by loading 1600 grams (g) of 2-ethyl-1-hexanol into a stainless steel reactor vessel followed by 11.3 g of 85 wt % aqueous potassium hydroxide and heat the mixture to 115° C. under a nitrogen blanket. Remove water by means of a vacuum to a water content of less than 2000 weight parts per million weight parts solution (ppm). Feed a mixture of 2400 g propylene oxide and 2400 g 1,2-butylene oxide into the reactor at a temperature of 130° C. and a pressure of 500 kiloPascals (kPa). Stir the mixture and allow to digest for 12 hours at 130° C. Remove residual catalyst by filtration through a magnesium silicate filtration bed at 50° C. to yield Comp Ex L, which has a KV40 of 17.7 cSt, KV100 of 3.81 cSt, a VI of 104 and a pour point of −59.0° C.

Prepare Example (Ex) 1 by loading 5805 g of comp Ex L into a stainless steel reactor vessel. Add 2604 g of sodium methoxide (25 wt % solution in methanol) and stir at 120° C. for 20 hours under vacuum (45 to less than one kPa) with nitrogen purging at 200 milliliters per minute and stirring at 180 revolutions per minute (RPM). Feed 639 g of methyl chloride into the reactor at a temperature of 80° C. and pressure of 170 kPa. Stir the mixture and allow to digest for one hour at 80° C. Flash for 20 minutes at 80° C. and apply vacuum to remove unreacted methyl chloride from the mixture. Stop stirring and allow to settle for 1.5 hours at 80° C. Decant 2793 g of brine phase. Add 100 g magnesium silicate and flash off residual water for one hour at 100° C. under vacuum and pressure below one kPa with nitrogen purging at 200 milliliters per minute and stirring at 180 RPM. Cool the product to 60° C. discharge 5904 g and filter through a magnesium silicate filtration bed at 50° C. to yield Ex 1. Capping conversion is 98.8%, KV40 is 10.3 cSt, KV100 is 3.1, VI is 173 and pour point is −74.0° C.

Comparative Example M and Example 2

Prepare Comp Ex M by loading 2369 g dodecanol (Nacol™ 12-99 (Nacol is a trademark of Sasol Germany GMBH)) into a stainless steel reactor vessel followed by 20.02 g of 45 wt % aqueous potassium hydroxide and heat the mixture to 115° C. under a nitrogen blanket. Remove water by means of a vacuum to a water content of less than 2000 weight parts per million weight parts solution (ppm). Feed a mixture of 1808.5 g propylene oxide and 1808.5 g 1,2-butylene oxide into the reactor at a temperature of 130° C. and pressure of 490 kPa. Stir the mixture and allow to digest for 14 hours at 130° C. Remove residual catalyst by filtration through a magnesium silicate filtration bed at 50° C. to yield Comp Ex M, which has a KV40 of 16.1 cSt, KV100 of 3.7 cSt, VI of 117 and a pour point of −39.0° C.

Prepare Ex 2 by loading 5797 g of Comp Ex M into a stainless steel reactor vessel and add 2795 g of sodium methoxide (25 wt % solution in methanol) and stir at 120° C. for 12 hours at 80° C. for 12 hours under vacuum (less than one kPa pressure) with nitrogen purge at 200 milliliters per minute and stirring at 180 RPM. Discharge 3825 g of mixture from the reactor and to the remaining 2264 g feed 252 g methyl chloride at 80° C. at a pressure of 260 kPa. Stir for 1.5 hours at 80° C. and then flash for 10 minutes at 80° C. under vacuum to remove unreacted methyl chloride and dimethyl ether. Add 796 g water and stir for 40 minutes at 80° C. to was the sodium chloride from the mixture. Stop stirring and let settle for one hour at 80° C. Decant 961 g brine phase and add 50 g magnesium silicate. Flash off residual water in one hour at 100° C. under vacuum (less than one kPa pressure) with 200 milliliter per minute nitrogen purge and 180 RPM stirring. Allow the product to cool to 60° C. and discharge 2218 g and filter though a magnesium silicate filtration bed at 50° C. to yield Ex 2, which has a capping efficiency of 93.7%, KV40 of 9.9 cSt, KV100 of 3.0 cSt, VI of 183 and pour point of −45.0° C.

Comparative Example N and Example 3

Prepare Comp Ex N by loading 1624 grams (g) of dodecanol (Nacol™ 12-99 (Nacol is a trademark of Sasol Germany GMBH)) into a stainless steel reactor vessel followed by 22.5 g of 45 wt % aqueous potassium hydroxide and heat the mixture to 115° C. under a nitrogen blanket. Remove water by means of vacuum to a level below 2000 ppm. Feed a mixture of 1698 g propylene oxide and 1698 g 1,2-butylene oxide into the reactor at a temperature of 130° C. and a pressure of 500 kiloPascals (kPa). Stir the mixture and allow to digest for 12 hours at 130° C. Remove residual catalyst by filtration through a magnesium silicate filtration bed at 50° C. to yield Comp Ex N, which has a KV40 of 21.1 cSt, KV100 of 4.56 cSt, and a VI of 134.

Prepare Ex 3 by loading 4586 g of comp Ex N into a stainless steel reactor vessel. Add 2003 g of sodium methoxide (25 wt % solution in methanol) and stir at 120° C. for 20 hours under vacuum (45 to less than one kPa) with nitrogen purging at 200 milliliters per minute and stirring at 180 revolutions per minute (RPM). Feed 515 g of methyl chloride into the reactor at a temperature of 80° C. and pressure of 170 kPa. Stir the mixture and allow to digest for one hour at 80° C. Flash for 20 minutes at 80° C. and apply vacuum to remove unreacted methyl chloride from the mixture. Add 1638 g water and mix for 60 minutes at 80° C. Stop stirring and allow to settle for 1.5 hours at 80° C. Decant 2144 g of brine phase. Add 100 g magnesium silicate and flash off residual water for one hour at 100° C. under vacuum and pressure below one kPa with nitrogen purging at 200 milliliters per minute and stirring at 180 RPM. Cool the product to 60° C. discharge 4736 g and filter through a magnesium silicate filtration bed at 50° C. to yield Ex 3. Capping conversion is 100%, KV40 is 13.45 cSt, KV100 is 3.76, and VI is 185.

Comparative Example O and Example 4

Prepare Comp Ex O by loading 2414 grams (g) of dodecanol (Nacol™ 12-99 (Nacol is a trademark of Sasol Germany GMBH)) into a stainless steel reactor vessel followed by 25.7 g of 45 wt % aqueous potassium hydroxide and heat the mixture to 115° C. under a nitrogen blanket. Remove water by means of vacuum to a level below 2000 ppm. Feed a mixture of 2654 g propylene oxide and 2654 g 1,2-butylene oxide into the reactor at a temperature of 130° C. and a pressure of 500 kiloPascals (kPa). Stir the mixture and allow to digest for 12 hours at 130° C. Remove residual catalyst by filtration through a magnesium silicate filtration bed at 50° C. to yield Comp Ex O, which has a KV40 of 22.4 cSt, KV100 of 4.8 cSt, a VI of 139 and a pour point of −47° C.

Prepare Ex 4 by loading 7839 g of comp Ex O into a stainless steel reactor vessel. Add 2902 g of sodium methoxide (25 wt % solution in methanol) and stir at 120° C. for 20 hours under vacuum (45 to less than one kPa) with nitrogen purging at 200 milliliters per minute and stirring at 180 revolutions per minute (RPM). Feed 711 g of methyl chloride into the reactor at a temperature of 80° C. and pressure of 170 kPa. Stir the mixture and allow to digest for one hour at 80° C. Flash for 20 minutes at 80° C. and apply vacuum to remove unreacted methyl chloride from the mixture. Add 2422 g water and mix for 60 minutes at 80° C. Stop stirring and allow to settle for 1.5 hours at 80° C. Decant 3083 g of brine phase. Add 100 g magnesium silicate and flash off residual water for one hour at 100° C. under vacuum and pressure below one kPa with nitrogen purging at 200 milliliters per minute and stirring at 180 RPM. Cool the product to 60° C. discharge 8003 g and filter through a magnesium silicate filtration bed at 50° C. to yield Ex 4. Capping conversion is 97.8%, KV40 is 14.4 cSt, KV100 is 3.97 cSt, VI is 188 and pour point is −53.0° C.

Comparative Example P and Example 5

Prepare Comp Ex P by loading 1614 grams (g) of dodecanol (Nacol™ 12-99 (Nacol is a trademark of Sasol Germany GMBH)) into a stainless steel reactor vessel followed by 11.3 g of 45 wt % aqueous potassium hydroxide and heat the mixture to 115° C. under a nitrogen blanket. Remove water by means of vacuum to a level below 2000 ppm. Feed a mixture of 755 g propylene oxide and 755 g 1,2-butylene oxide into the reactor at a temperature of 130° C. and a pressure of 500 kiloPascals (kPa). Stir the mixture and allow to digest for 12 hours at 130° C. Remove residual catalyst by filtration through a magnesium silicate filtration bed at 50° C. to yield Comp Ex P, which has a KV40 of 11.5 cSt, KV100 of 2.83 cSt, a VI of 87.1 and a pour point of −59.0° C.

Prepare Ex 5 by loading 2959 g of comp Ex P into a stainless steel reactor vessel. Add 1300 g of sodium methoxide (25 wt % solution in methanol) and stir at 120° C. for 20 hours under vacuum (45 to less than one kPa) with nitrogen purging at 200 milliliters per minute and stirring at 180 revolutions per minute (RPM). Feed 737 g of benzyl chloride into the reactor at a temperature of 80° C. and pressure of 170 kPa. Stir the mixture and allow to digest for one hour at 80° C. Flash for 20 minutes at 80° C. and apply vacuum to remove unreacted benzyl chloride from the mixture. Add 1098 g water and mix for 60 minutes at 80° C. Stop stirring and allow to settle for 1.5 hours at 80° C. Decant 1428 g of brine phase. Add 100 g magnesium silicate and flash off residual water for one hour at 100° C. under vacuum and pressure below one kPa with nitrogen purging at 200 milliliters per minute and stirring at 180 RPM. Cool the product to 60° C. discharge 3450 g and filter through a magnesium silicate filtration bed at 50° C. to yield Ex 5. Capping conversion is 69.4%, KV40 is 10.2 cSt, KV100 is 2.97, VI is 154 and pour point is −36.0° C.

Comparative Example Q and Examples 6, 7 and 8

Prepare Comp Ex Q by loading 2369 grams (g) of dodecanol (Nacol™ 12-99 (Nacol is a trademark of Sasol Germany GMBH)) into a stainless steel reactor vessel followed by 20.0 g of 45 wt % aqueous potassium hydroxide and heat the mixture to 115° C. under a nitrogen blanket. Remove water by means of vacuum to a level below 2000 ppm. Feed a mixture of 1809 g propylene oxide and 1809 g 1,2-butylene oxide into the reactor at a temperature of 130° C. and a pressure of 500 kiloPascals (kPa). Stir the mixture and allow to digest for 12 hours at 130° C. Remove residual catalyst by filtration through a magnesium silicate filtration bed at 50° C. to yield Comp Ex Q, which has a KV40 of 16.1 cSt, KV100 of 3.71 cSt, a VI of 118 and a pour point of −39.0° C.

Prepare Ex 6 by loading 2155 g of Comp Ex Q into a stainless steel reactor vessel. Add 1028 g of sodium methoxide (25 wt % solution in methanol) and stir at 120° C. for 20 hours under vacuum (45 to less than one kPa) with nitrogen purging at 200 milliliters per minute and stirring at 180 revolutions per minute (RPM). Feed 252 g of methyl chloride into the reactor at a temperature of 80° C. and pressure of 170 kPa. Stir the mixture and allow to digest for one hour at 80° C. Flash for 20 minutes at 80° C. and apply vacuum to remove unreacted methyl chloride from the mixture. Add 796 g water and mix for 60 minutes at 80° C. Stop stirring and allow to settle for 1.5 hours at 80° C. Decant 961 g of brine phase. Add 100 g magnesium silicate and flash off residual water for one hour at 100° C. under vacuum and pressure below one kPa with nitrogen purging at 200 milliliters per minute and stirring at 180 RPM. Cool the product to 60° C. discharge 2218 g and filter through a magnesium silicate filtration bed at 50° C. to yield Ex 6. Capping conversion is 93.7%, KV40 is 9.88 cSt, KV100 is 3.03 cSt, VI is 183 and pour point is −45.0° C.

Prepare Ex 7 by loading 1798 g of Comp Ex Q into a stainless steel reactor vessel. Add 858 g of sodium methoxide (25 wt % solution in methanol) and stir at 120° C. for 20 hours under vacuum (45 to less than one kPa) with nitrogen purging at 200 milliliters per minute and stirring at 180 revolutions per minute (RPM). Feed 386 g of butyl chloride into the reactor at a temperature of 80° C. and pressure of 170 kPa. Stir the mixture and allow to digest for one hour at 80° C. Flash for 20 minutes at 80° C. and apply vacuum to remove unreacted butyl chloride from the mixture. Add 693 g water and mix for 60 minutes at 80° C. Stop stirring and allow to settle for 1.5 hours at 80° C. Decant 857 g of brine phase. Add 100 g magnesium silicate and flash off residual water for one hour at 100° C. under vacuum and pressure below one kPa with nitrogen purging at 200 milliliters per minute and stirring at 180 RPM. Cool the product to 60° C. discharge 1866 g and filter through a magnesium silicate filtration bed at 50° C. to yield Ex 7. Capping conversion is 51.7%, KV40 is 12.7 cSt, KV100 is 3.44 cSt, VI is 156 and pour point is −45.0° C.

Prepare Ex 8 by loading 181 g of Comp Ex Q into a stainless steel reactor vessel. Add 864 g of sodium methoxide (25 wt % solution in methanol) and stir at 120° C. for 20 hours under vacuum (45 to less than one kPa) with nitrogen purging at 200 milliliters per minute and stirring at 180 revolutions per minute (RPM). Feed 355 g of benzyl chloride into the reactor at a temperature of 80° C. and pressure of 170 kPa. Stir the mixture and allow to digest for one hour at 80° C. Flash for 20 minutes at 80° C. and apply vacuum to remove unreacted benzyl chloride from the mixture. Add 711 g water and mix for 60 minutes at 80° C. Stop stirring and allow to settle for 1.5 hours at 80° C. Decant 874 g of brine phase. Add 100 g magnesium silicate and flash off residual water for one hour at 100° C. under vacuum and pressure below one kPa with nitrogen purging at 200 milliliters per minute and stirring at 180 RPM. Cool the product to 60° C. discharge 2058 g and filter through a magnesium silicate filtration bed at 50° C. to yield Ex 8. Capping conversion is 67.7%, KV40 is 14.8 cSt, KV100 is 3.87 cSt, VI is 161 and pour point is −48.0° C.

Comparative Example R and Example 9

Prepare Comp Ex R by loading 1292 grams (g) of iso tri decyl alcohol (Exxal™ 13; Exxal is a trademark of Exxon-Mobil) into a stainless steel reactor vessel followed by 11.8 g of 45 wt % aqueous potassium hydroxide and heat the mixture to 115° C. under a nitrogen blanket. Remove water by means of vacuum to a level below 2000 ppm. Feed a mixture of 1125 g propylene oxide and 1125 g 1,2-butylene oxide into the reactor at a temperature of 130° C. and a pressure of 500 kiloPascals (kPa). Stir the mixture and allow to digest for 12 hours at 130° C. Remove residual catalyst by filtration through a magnesium silicate filtration bed at 50° C. to yield Comp Ex R, which has a KV40 of 25.0 cSt, KV100 of 4.64 cSt, a VI of 102 and a pour point of −56.0° C.

Prepare Ex 9 by loading 3390 g of comp Ex R into a stainless steel reactor vessel. Add 1504 g of sodium methoxide (25 wt % solution in methanol) and stir at 120° C. for 20 hours under vacuum (45 to less than one kPa) with nitrogen purging at 200 milliliters per minute and stirring at 180 revolutions per minute (RPM). Feed 369 g of methyl chloride into the reactor at a temperature of 80° C. and pressure of 170 kPa. Stir the mixture and allow to digest for one hour at 80° C. Flash for 20 minutes at 80° C. and apply vacuum to remove unreacted methyl chloride from the mixture. Add 1273 g water and mix for 60 minutes at 80° C. Stop stirring and allow to settle for 1.5 hours at 80° C. Decant 1683 g of brine phase. Add 100 g magnesium silicate and flash off residual water for one hour at 100° C. under vacuum and pressure below one kPa with nitrogen purging at 200 milliliters per minute and stirring at 180 RPM. Cool the product to 60° C. discharge 3407 g and filter through a magnesium silicate filtration bed at 50° C. to yield Ex 9. Capping conversion is 99.2%, KV40 is 14.4 cSt, KV100 is 3.76, VI is 159 and pour point is −68.0° C.

TABLE 2

| Sample | Initiator | $(AO)_n$ component (weight ratio of each alkylene oxide monomer residual) | Molecular Weight (g/mol) | Cap | KV40, cSt | KV100, cSt | Viscosity Index (VI) | Delta VI |
|---|---|---|---|---|---|---|---|---|
| Comp Ex L | 2-ethylhexanol | PO/BO (50/50) | 492 | None | 17.7 | 3.81 | 104 | |
| Ex 1 | 2-ethylhexanol | PO/BO (50/50) | 506 | Methyl | 10.3 | 3.1 | 173 | 69 |
| Comp Ex M | Dodecanol | PO/BO (50/50) | 460 | None | 16.1 | 3.7 | 117 | |
| Ex 2 | Dodecanol | PO/BO (50/50) | 474 | Methyl | 9.9 | 3.00 | 183 | 66 |
| Comp Ex N | Dodecanol | PO/BO (50/50) | 565 | None | 21.1 | 4.56 | 134 | |
| Ex 3 | Dodecanol | PO/BO (50/50) | 579 | Methyl | 13.45 | 3.76 | 185 | 51 |
| Comp Ex O | Dodecanol | PO/BO (50/50) | 587 | None | 22.4 | 4.80 | 139 | |
| Ex 4 | Dodecanol | PO/BO (50/50) | 603 | Methyl | 14.4 | 3.97 | 188 | 50 |
| Comp Ex P | Dodecanol | PO/BO (50/50) | 357 | None | 11.5 | 2.83 | 87 | |
| Ex 5 | Dodecanol | PO/BO (50/50) | 409 | Benzyl | 10.2 | 2.97 | 154 | 67 |
| Comp Ex Q | Dodecanol | PO/BO (50/50) | 460 | None | 16.1 | 3.7 | 118 | |
| Ex 6 | Dodecanol | PO/BO (50/50) | 474 | Methyl | 9.88 | 3.03 | 183 | 65 |
| Ex 7 | Dodecanol | PO/BO (50/50) | 495 | Butyl | 12.7 | 3.44 | 156 | 36 |
| Ex 8 | Dodecanol | PO/BO (50/50) | 521 | Benzyl | 14.8 | 3.87 | 161 | 45 |
| Comp Ex R | Tridecanol | PO/BO (50/50) | 534 | None | 25 | 4.64 | 102 | |
| Ex 9 | Tridecanol | PO/BO (50/50) | 548 | Methyl | 14.4 | 3.76 | 159 | 57 |

Effect of Capping an OSP of Higher Viscosity

The groupings below provide a Comp Ex OSP and one or more than one Comp Ex of a capped version of the same OSP that falls outside the scope of the invention for having a KV100 of 4.5 cSt or higher. Each of the non-capped polyalkylene glycols has aKV100 that is greater than five cSt. Kinematic viscosity at 40° C. (KV40) and at 100 C (KV100), viscosity index (VI) and the difference between viscosity index of the capped and non-capped PAG (Delta VI) is provided in Table 3. The data reveals the dramatic increase in viscosity index and concomitant decrease in kinematic viscosity after capping Comparative Examples S and T Prepare Comp Ex S by loading 1554 grams (g) of dodecanol (Nacol™ 12-99 (Nacol is a trademark of Sasol Germany GMBH)) into a stainless steel reactor vessel followed by 38.5 g of 45 wt % aqueous potassium hydroxide and heat the mixture to 115° C. under a nitrogen blanket. Remove water by means of vacuum to a level below 2000 ppm. Feed a mixture of 5071 g propylene oxide and 5071 g 1,2-butylene oxide into the reactor at a temperature of 130° C. and a pressure of 500 kiloPascals (kPa). Stir the mixture and allow to digest for 12 hours at 130° C. Remove residual catalyst by filtration through a magnesium silicate filtration bed at 50° C. to yield Comp Ex S, which has a KV40 of 68.0 cSt, KV100 of 11.6 cSt, and a VI of 166.

Prepare Comp Ex T by loading 4265 g of comp Ex S into a stainless steel reactor vessel. Add 834 g of sodium methoxide (25 wt % solution in methanol) and stir at 120° C. for 20 hours under vacuum (45 to less than one kPa) with nitrogen purging at 200 milliliters per minute and stirring at 180 revolutions per minute (RPM). Feed 214 g of methyl chloride into the reactor at a temperature of 80° C. and pressure of 170 kPa. Stir the mixture and allow to digest for one hour at 80° C. Flash for 20 minutes at 80° C. and apply vacuum to remove unreacted methyl chloride from the mixture. Add 954 g water and mix for 60 minutes at 80° C. Stop stirring and allow to settle for 1.5 hours at 80° C. Decant 816 g of brine phase. Add 100 g magnesium silicate and flash off residual water for one hour at 100° C. under vacuum and pressure below one kPa with nitrogen purging at 200 milliliters per minute and stirring at 180 RPM. Cool the product to 60° C. discharge 4100 g and filter through a magnesium silicate filtration bed at 50° C. to yield Comp Ex T. Capping conversion is 97.1%, KV40 is 50.9 cSt, KV100 is 10.3 cSt, and VI is 196.

Comparative Examples U and V

Prepare Comp Ex U by loading 1290 grams (g) of dodecanol (Nacol™ 12-99 (Nacol is a trademark of Sasol Germany GMBH)) into a stainless steel reactor vessel followed by 27.7 g of 45 wt % aqueous potassium hydroxide and heat the mixture to 115° C. under a nitrogen blanket. Remove water by means of vacuum to a level below 2000 ppm. Feed a mixture of 2477 g propylene oxide and 2477 g 1,2-butylene oxide into the reactor at a temperature of 130° C. and a pressure of 500 kiloPascals (kPa). Stir the mixture and allow to digest for 12 hours at 130° C. Remove residual catalyst by filtration through a magnesium silicate filtration bed at 50° C. to yield Comp Ex U, which has a KV40 of 39.4 cSt, KV100 of 7.49 cSt, and a VI of 160.

Prepare comp Ex V by loading 5787 g of comp Ex U into a stainless steel reactor vessel. Add 1652 g of sodium methoxide (25 wt % solution in methanol) and stir at 120° C. for 20 hours under vacuum (45 to less than one kPa) with nitrogen purging at 200 milliliters per minute and stirring at 180 revolutions per minute (RPM). Feed 425 g of methyl chloride into the reactor at a temperature of 80° C. and pressure of 170 kPa. Stir the mixture and allow to digest for one hour at 80° C. Flash for 20 minutes at 80° C. and apply vacuum to remove unreacted methyl chloride from the mixture. Add 1347 g water and mix for 60 minutes at 80° C. Stop stirring and allow to settle for 1.5 hours at 80° C. Decant 1636 g of brine phase. Add 100 g magnesium silicate and flash off residual water for one hour at 100° C. under vacuum and pressure below one kPa with nitrogen purging at 200 milliliters per minute and stirring at 180 RPM. Cool the product to 60° C. discharge 5818 g and filter through a magnesium silicate filtration bed at 50° C. to yield Comp Ex V. Capping conversion is 99.0%, KV40 is 28.0 cSt, KV100 is 6.5 cSt, and VI is 199.

Comparative Examples W and X

Prepare Comp Ex W by loading 1289 grams (g) of dodecanol (Nacol™ 12-99 (Nacol is a trademark of Sasol Germany GMBH)) into a stainless steel reactor vessel followed by 27.7 g of 45 wt % aqueous potassium hydroxide and heat the mixture to 115° C. under a nitrogen blanket. Remove water by means of vacuum to a level below 2000 ppm. Feed a mixture of 3711 g propylene oxide and 1237 g 1,2-butylene oxide into the reactor at a temperature of 130° C. and a pressure of 500 kiloPascals (kPa). Stir the mixture and allow to digest for 12 hours at 130° C. Remove residual catalyst by filtration through a magnesium silicate filtration bed at 50° C. to yield Comp Ex W, which has a KV40 of 37.4 cSt, KV100 of 7.5 cSt, and a VI of 173.

Prepare comp Ex X by loading 5797 g of comp Ex W into a stainless steel reactor vessel. Add 1602 g of sodium methoxide (25 wt % solution in methanol) and stir at 120° C. for 20 hours under vacuum (45 to less than one kPa) with nitrogen purging at 200 milliliters per minute and stirring at 180 revolutions per minute (RPM). Feed 412 g of methyl chloride into the reactor at a temperature of 80° C. and pressure of 170 kPa. Stir the mixture and allow to digest for one hour at 80° C. Flash for 20 minutes at 80° C. and apply vacuum to remove unreacted methyl chloride from the mixture. Add 1297 g water and mix for 60 minutes at 80° C. Stop stirring and allow to settle for 1.5 hours at 80° C. Decant 1608 g of brine phase. Add 100 g magnesium silicate and flash off residual water for one hour at 100° C. under vacuum and pressure below one kPa with nitrogen purging at 200 milliliters per minute and stirring at 180 RPM. Cool the product to 60° C. discharge 5830 g and filter through a magnesium silicate filtration bed at 50° C. to yield Comp Ex X. Capping conversion is 100%, KV40 is 26.1 cSt, KV100 is 6.35 cSt, and VI is 210.

TABLE 3

| Sample | Initiator | $(AO)_n$ component (weight ratio of each alkylene oxide monomer residual) | Molecular Weight (g/mol) | Cap | KV40, cSt | KV100, cSt | Viscosity Index (VI) | Delta VI |
|---|---|---|---|---|---|---|---|---|
| Comp Ex S | Dodecanol | PO/BO (50/50) | 1176 | None | 68 | 11.6 | 166 | |
| Comp Ex T | Dodecanol | PO/BO (50/50) | 1190 | Methyl | 50.9 | 10.3 | 196 | 30 |
| Comp Ex U | Dodecanol | PO/BO (50/50) | 874 | None | 39.4 | 7.49 | 160 | |
| Comp Ex V | Dodecanol | PO/BO (50/50) | 888 | Methyl | 28 | 6.5 | 199 | 39 |
| Comp Ex W | Dodecanol | PO/BO (75/25) | 868 | None | 37.4 | 7.5 | 173 | |
| Comp Ex X | Dodecanol | PO/BO ( 75/25) | 882 | Methyl | 26.1 | 6.35 | 210 | 37 |

The invention claimed is:

1. A capped oil soluble polyalkylene glycol having the following structure:

$$R^1O\text{-}(AO)_n\text{—}R^2$$

where: $R^1$ is a linear or branched alkyl or aryl with one to 18 carbon atoms; AO refers to residuals of monomers selected from 1,2-butylene oxide and 1,2-propylene oxide selected so that at least 50 weight-percent of the $(AO)_n$, component is 1,2-butylene oxide residuals; n is a number from 3 to 7 and is selected to provide a kinematic viscosity at 100 degrees Celsius of less than 5 centiStokes for the non-capped polyalkylene glycol; and $R^2$ is a linear or branched alkyl or aryl having from 1-8 carbon atoms and wherein the capped oil soluble polyalkylene glycol is characterized by having a kinematic viscosity of less than 4.5 centiStokes at 100 degrees Celsius and a viscosity index of greater than 150.

2. The capped oil soluble polyalkylene glycol of claim 1, further characterized by $R^1$ having 8-14 carbon atoms.

3. The capped oil soluble polyalkylene glycol of claim 1, further characterized by $R^1$ being selected from a group consisting of the residual of 2-ethylhexanol, the residual of dodecanol and the residual to tridecanol.

4. The capped oil soluble polyalkylene glycol of claim 1, further characterized by $R^2$ having from 1-6 carbon atoms.

5. The capped oil soluble polyalkylene glycol of claim 1, further characterized by $R^2$ being selected from a group consisting of methyl, butyl and benzyl.

6. The capped oil soluble polyalkylene glycol of claim 1, further characterized by $(AO)_n$, being selected from homopolymer of 1,2-butylene oxide and 50/50 weight ratio copolymers of 1,2-butylene oxide with propylene oxide.

7. The capped oil soluble polyalkylene glycol of claim 1, further characterized by $(AO)_n$, being a copolymer of 1,2-butylene oxide and propylene oxide.

* * * * *